United States Patent [19]

Kruse et al.

[11] Patent Number: 4,793,260

[45] Date of Patent: Dec. 27, 1988

[54] SPIN-STABILIZED BOMBLET-CARRYING PROJECTILE

[75] Inventors: Heinz J. Kruse, Ratingen; Karin Fey, Düsseldorf; Klaus D. Karius, Jüchen; Harmut Schilling, Kaarst, all of Fed. Rep. of Germany

[73] Assignee: Rheinmetall GmbH, Düsseldorf, Fed. Rep. of Germany

[21] Appl. No.: 91,012

[22] Filed: Aug. 31, 1987

[30] Foreign Application Priority Data

Aug. 30, 1986 [DE] Fed. Rep. of Germany ..... 3629668

[51] Int. Cl.[4] ..... F42B 13/50

[52] U.S. Cl. ..... 102/489; 102/357; 102/505; 102/517

[58] Field of Search ..... 102/340, 342, 351, 357, 102/393, 489, 473, 517–519, 505, 703

[56] References Cited

U.S. PATENT DOCUMENTS

| | | | |
|---|---|---|---|
| 3,750,575 | 8/1973 | Heede et al. . | |
| 3,938,442 | 2/1976 | Donadio | 102/703 |
| 3,981,244 | 9/1976 | Adimari et al. . | |
| 4,183,302 | 1/1980 | Schillreff . | |
| 4,458,596 | 7/1984 | Armstrong | 102/393 |
| 4,480,552 | 11/1984 | Eckel et al. | 102/393 |

FOREIGN PATENT DOCUMENTS

| | | | |
|---|---|---|---|
| 144293 | 6/1985 | European Pat. Off. | 102/489 |
| 2854120 | 6/1980 | Fed. Rep. of Germany . | |
| 282900 | 9/1980 | Fed. Rep. of Germany . | |

OTHER PUBLICATIONS

Rheinmetall "Handbook on Weaponry", 1982, pp. 178–181.

*Primary Examiner*—Harold J. Tudor
*Attorney, Agent, or Firm*—Spencer & Frank

[57] ABSTRACT

A spin-stabilized projectile includes a casing, a plurality of bomblets accommodated in the casing, filler pieces inserted between the casing and the bomblets, and a device for ejecting the bomblets by explosive force from the projectile at a predetermined point along a trajectory thereof. The filler pieces are of steel or tungsten and are distributed in the casing such that the projectile flies stably up to the point of ejection of the bomblets.

3 Claims, 1 Drawing Sheet

SPIN-STABILIZED BOMBLET-CARRYING PROJECTILE

BACKGROUND OF THE INVENTION

1. Field of the Invention

The invention relates to a spin-stabilized payload-carrying projectile containing bomblets and fillers disposed between the bomblets and the housing of the projectile.

2. Discussion of the Prior Art

Such payload-carrying projectiles are described, for example, on page 113 of the magazine "Wehrtechnik" [Military Engineering], vol. 10/85. A corresponding bomblet-carrying projectile is also shown in FIG. 3 of U.S. Pat. No. 3,981,244.

In known bomblet-carrying projectiles the fillers are normally made of plastic or aluminum and are used for securing the bomblets inside the projectile as well as for imparting the spin of the payload-carrying projectile to the bomblets. The longitudinal and transverse moments of inertia of the payload-carrying projectile which determine the ballistic stability are in general determined in these projectiles by many quantities including: the mass of the bomblets, the projectile base, the housing of the payload-carrying projectile as well as the nose of the projectile and the ejection charge contained in the nose of the projectile. A spinning projectile is considered to be stable if an incident angle produced by a disturbance disappears again.

If the distribution of mass of the bomblet-carrying projectile mentioned above is changed by the use of a considerably thinner housing than the customary housing of a payload-carrying projectile (for example in order to contain larger bomblets in the payload-carrying projectile), a negative effect on the ballistic stability of the bomblet-carrying projectile can result. This is so, because a change of the distribution of mass also leads to a change of the longitudinal and lateral moments of inertia which may result in a change in the ballistic stability.

SUMMARY OF THE INVENTION

It is an object of the present invention to achieve in a particularly simple manner the distribution of mass (or the moment of inertia) necessary for ballistic stability in bomblet-carrying projectiles with thin housings.

The above and other objects are accomplished by the invention in which a projectile for dispensing a payload at a selected point along its trajectory comprises filler pieces which are of steel or tungsten, and which are distributed in the projectile casing between the bomblets such that the projectile flies stably up to the point of ejection of the bomblets.

DESCRIPTION OF THE PREFERRED EMBODIMENT

Figure 1:
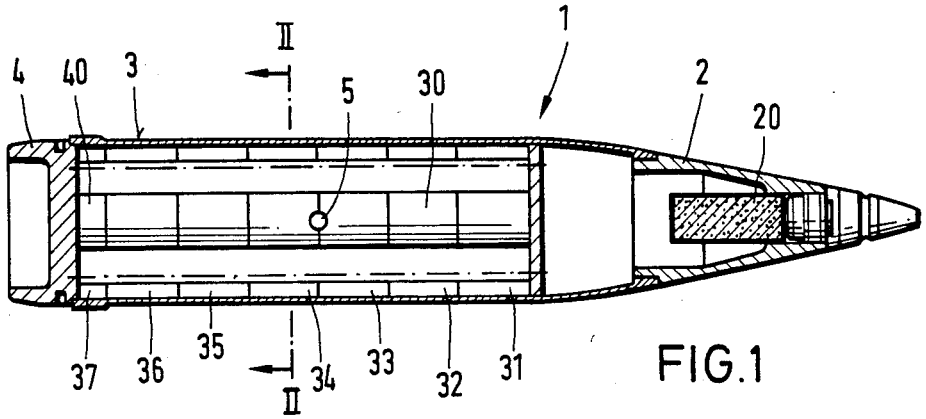
FIG. 1 is a longitudinal section of a preferred embodiment of the invention.

In FIG. 1 the bomblet-carrying projectile 1 includes a nose 2 of the projectile, an ejection charge 20 contained in the nose, a casing or shell 3 of the payload-carrying projectile and a base 4.

The bomblets 30 and fillers 31–37 are inside the bomblet-carrying projectile 1. The center of gravity of the bomblet-carrying projectile 1 is at 5. Adapter rings 40 which contain the fuses for the rear layer of bomblets, are located between the projectile base 4 and the rear layer of bomblets oriented toward the projectile base.

Figure 2:
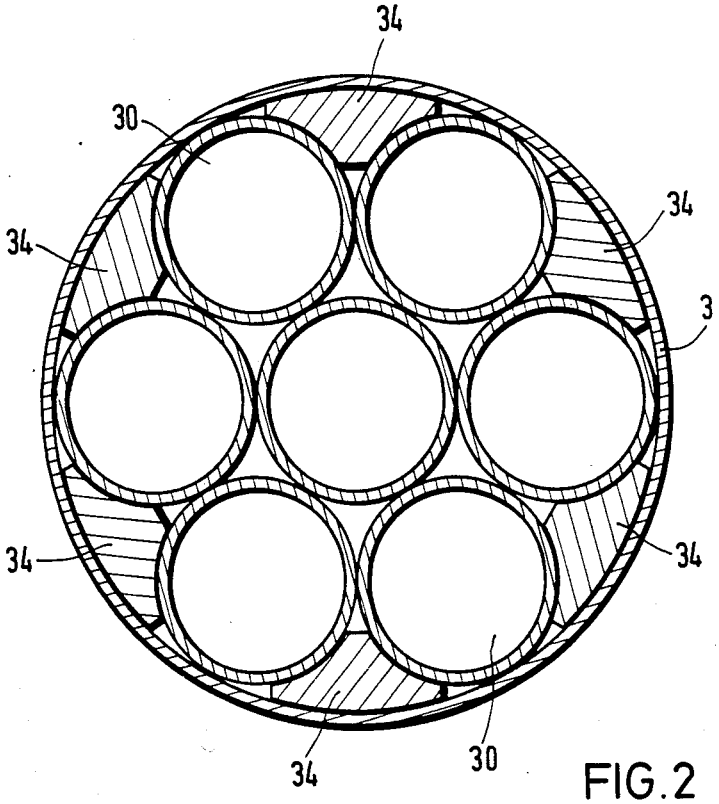
FIG. 2 is an enlarged sectional view taken along line II—II of FIG. 1.

In FIG. 2 a cross section through the bomblet-carrying projectile is shown.

The bomblet-carrying projectile can for example, be a 155 mm round, which ignites the ejection charge 20 after a pre-set time interval. The bomblets 30 are pushed out of the rear by the gas pressure being created in the nose of the projectile. In the present example six layers of bomblets with seven bomblets per layer are discharged over the target.

To utilize the interior of the bomblet-carrying projectile 1 as optimally as possible, a projectile housing 3 as thin as possible is to be used, i.e. the ratio of the wall thickness of the casing 3 of the payload-carrying projectile to the caliber of the barrel should be less than 0.05.

If the bomblet-carrying projectile is to fly stably, the distribution of mass must be selected such that an incident angle produced by a disturbance disappears again. In connection with the stability requirements of spin-stabilized projectiles see the "Handbook on Weaponry", second English Edition, 1982, pages 178–180 (published by Rheinmetall GmbH).

According to the invention, to achieve the mass distribution, that is, the moments of inertia about the projectile axis and a transverse axis passing through the center of gravity of the bomblet-carrying projectile 1, a particular material and a particular placement of the fillers 31–37 are provided.

In the bomblet-carrying projectile shown, the fillers 31, 32 and 35, 36, 37 are of steel. The fillers 33 and 34 which are in the vicinity of the center of gravity 5 are of heavy tungsten metal.

As seen in FIG. 2, the bomblets are of generally circular cross-sectional outline and are arranged in a cluster about the longitudinal axis A of the projectile. Circumferentially adjoining bomblets 30 are in contact with one another and each bomblet 30 furthermore contacts the inner wall face of the casing 3. The filler pieces 34, as well as the other filler pieces which are, as viewed axially, in front of or behind the filler pieces 34, are each situated in the space which is of generally triangular cross section and which is defined by two adjoining bomblets 30 and the inner surface portion of the casing 3 extending between such two adjoining bomblets. For a matching fit, each filler piece has two concave face portions complemental with the convex face portions of the adjoining bomblets 30 and a convex face portion which, in turn, is conforming to the concave inner wall portion of the casing 3.

By means of this arrangement, the following mechanical data are arrived at with a bomblet weight of 0.432 kg:

Mass: 47.8 kg

Longitudinal moment of inertia: 163,000 kg×mm$^2$

Transverse moment of inertia: 1,796,000 kg×mm$^2$

Revolution: U=15,600 rpm

A factor of stability S of 1.42 is calculated from these data, in accordance with the above-cited Rheinmetall publication. Since stable flight is ensured when $S \geqq 1$, the embodiment described above produces a stably flying projectile. If instead of steel and heavy tungsten metal the normally used plastic fillers have been employed, a factor of stability of S=0.79 would have resulted; or when using aluminum fillers S=0.86 would have resulted.

It will be understood that the above description of the present invention is susceptible to various modifications, changes and adaptations, and the same are intended to be comprehended within the meaning and range of equivalents of the appended claims.

What is claimed is:

1. In a spin-stabilized projectile including a casing and a longitudinal axis, a plurality of bomblets accommodated in the casing parallel to said axis, filler pieces inserted between the casing and the bomblets, means for ejecting the bomblets by explosive force from the projectile at a predetermined point along a trajectory thereof; the improvement wherein said filler pieces are arranged in a series parallel to said axis; said series having a central part located centrally as viewed in a direction parallel to said axis, and two flanking parts on both sides of the central part; filler pieces forming said central part are of tungsten and filler pieces forming said flanking parts are of steel.

2. A spin-stabilized projectile according to claim 1, wherein each said bomblet has a generally circular cross section; further wherein said bomblets are arranged in a cluster about said axis and each said filler piece is situated between and in contact with two circumferentially adjoining bomblets and said casing.

3. A spin-stabilized projectile according to claim 2, wherein each filler piece has two concave face portions conforming to convex outer face portions of respective said bomblets and a convex face portion conforming to a concave inner face portion of said casing.

* * * * *